US008431181B2

(12) United States Patent
Cai et al.

(10) Patent No.: US 8,431,181 B2
(45) Date of Patent: Apr. 30, 2013

(54) METHOD FOR SURFACE TREATING COLD CATHODE

(75) Inventors: Qi Cai, Beijing (CN); Tong-Feng Gao, Beijing (CN); Xing Zhang, Beijing (CN); Liang Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 534 days.

(21) Appl. No.: 12/650,817

(22) Filed: Dec. 31, 2009

(65) Prior Publication Data

US 2011/0059671 A1 Mar. 10, 2011

(30) Foreign Application Priority Data

Sep. 4, 2009 (CN) ..... 2009 1 0190152

(51) Int. Cl.
*B05D 5/06* (2006.01)

(52) U.S. Cl.
USPC ..... 427/64

(58) Field of Classification Search ..... 427/64
See application file for complete search history.

(56) References Cited

U.S. PATENT DOCUMENTS

| | | | | |
|---|---|---|---|---|
| 2004/0067602 | A1* | 4/2004 | Jin | 438/22 |
| 2005/0129858 | A1 | 6/2005 | Jin et al. | |
| 2007/0087475 | A1* | 4/2007 | Kanazawa et al. | 438/106 |
| 2007/0262687 | A1* | 11/2007 | Li | 313/311 |
| 2008/0139073 | A1* | 6/2008 | Kim et al. | 445/24 |

FOREIGN PATENT DOCUMENTS

| | | | |
|---|---|---|---|
| CN | 1630002 | | 6/2005 |
| CN | 101585534 | A | 11/2009 |
| JP | 2005183370 | A | 7/2005 |
| JP | 2006-140077 | | 6/2006 |

OTHER PUBLICATIONS

N.S.Lee, D.S. Chung et al., Application of carbon nanotubes to field emission displays, Diamond and Related Materials, 2001, pp. 265-270, vol. 10.

* cited by examiner

*Primary Examiner* — Michael Cleveland
*Assistant Examiner* — Robert Vetere
(74) *Attorney, Agent, or Firm* — Altis Law Group, Inc.

(57) ABSTRACT

A method for surface treating a cold cathode includes the following steps. A cold cathode is provided and the cold cathode includes a plurality of field emitters. A liquid glue is placed on a surface of the cold cathode. The liquid glue is cured to form solid glue on the surface of the cold cathode. The solid glue is removed to allow the plurality of field emitters to stand upright.

14 Claims, 2 Drawing Sheets

METHOD FOR SURFACE TREATING COLD CATHODE

CROSS-REFERENCE TO RELATED APPLICATIONS

This application claims all benefits accruing under 35 U.S.C. §119 from China Patent Application No. 200910190152.1, filed on Sep. 4, 2009 in the China Intellectual Property Office.

BACKGROUND

1. Technical Field

The present disclosure relates to surface treating methods and, particularly, to a method for surface treating a cold cathode.

2. Description of Related Art

The cold cathode prepared by a screen-printing method is low cost and can be used for field emission flat-panel displays and other vacuum microelectronic devices. Conventional cold cathodes can be prepared by screen-printing a mixture of carbon nanotubes and ordinary conductive paste or a mixture of carbon nanotubes, conductive silver powders, binding materials, and an organic solvent. After a high temperature treatment, the organic solvent is removed, and the acquired cold cathode can include carbon nanotubes, conductive metal particles, and glass-phase solid binding materials. The carbon nanotubes can be located at a surface of the cold cathode and serve as emitters thereof.

However, the surface of the cold cathode is always covered by glass-phase solid binding materials and other impurities, and the number of the carbon nanotubes exposed out of the surface thereof is low, thus the emitting current of the cold cathode is low. Therefore, it is necessary to use a surface treating method to improve the emitting properties of the cold cathode.

A conventional method for treating the cold cathode is executed using a sticky tape. The sticky tape is adhered on a surface of the cold cathode, heated to a certain temperature, and then taken away from the cold cathode to cause the carbon nanotubes at the surface of the cold cathode to stand erect. However, a heating temperature of the sticky tape affects the cold cathode. If the heating temperature is too low, the carbon nanotubes would be completely removed from the surface of the cold cathode. If the heating temperature is too high, there would be sticky tape residue on the surface of the cold cathode, thereby affecting emission properties and lifetime of the cold cathode. Further, when the sticky tape is adhered on the surface of the cold cathode, it is difficult for the sticky tape to closely contact the surface of the cold cathode, resulting in air filled between the sticky tape and the cold cathode. The carbon nanotubes exposed to the air will not contact the sticky tape. Accordingly, when the sticky tape is taken away from the cold cathode, the carbon nanotubes exposed to the residual air are arranged disorderly, thereby reducing field emission uniformity of the cold cathode.

What is needed, therefore, is a method for surface treating a cold cathode in which the above problems are eliminated or at least alleviated.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
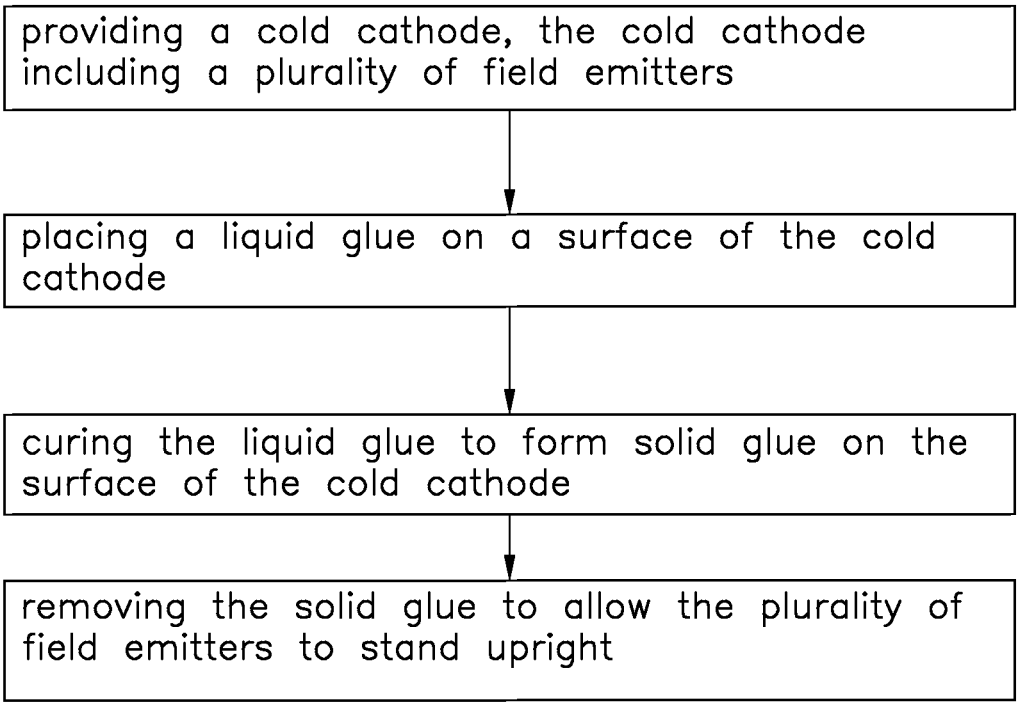
FIG. 1 is a chart of one embodiment of a method for surface treating a cold cathode.

Referring to FIG. 1, one embodiment of a method for surface treating a cold cathode includes:

providing a cold cathode, the cold cathode including a plurality of field emitters;

placing a liquid glue on a surface of the cold cathode;

curing the liquid glue to form solid glue on the surface of the cold cathode; and removing the solid glue to allow the plurality of field emitters to stand upright.

The field emitters can be one-dimensional field emitters. The one-dimensional field emitters have a large ratio of length to diameter, and can emit electrons at a low voltage. The one-dimensional field emitters can be, for example, nanotubes, nanowires, nanofibers, or nanorods. The field emitters can also be nanoribbons. The nanowires include oxide nanowires, nitride nanowires, or carbide nanowires. The oxide nanowires can be aluminum oxide ($Al_2O_3$) nanowires, magnesium oxide (MgO) nanowires, zirconia (ZrO) nanowires, titanium dioxide ($TiO_2$) nanowires, or calcium oxide (CaO) nanowires. The nitride nanowires can be aluminum nitride (AlN) nanowires, boron nitride (BN) nanowires, silicon nitride (SiN) nanowires, or titanium nitride (TiN) nanowires. The carbide nanowires can be silicon carbide (SiC) nanowires, titanium carbide (TiC) nano-wire, tungsten carbide (WC) nanowires, zirconium carbide (ZrC) nanowires, or niobium carbide (NbC) nanowires. The nanofibers can be carbon fibers. The one-dimensional field emitters can also be one-dimensional composite. For example, a layer of modification material can be coated on the surface of the aforementioned one-dimensional field emitters to improve the emission properties of the one-dimensional field emitters.

In one embodiment, the one-dimensional field emitters are carbon nanotubes. The carbon nanotubes include at least one of single-walled carbon nanotubes, double-walled carbon nanotubes, and multi-walled carbon nanotubes. Diameters of the single-walled carbon nanotubes can range from about 0.5 nanometers to about 50 nanometers. Diameters of the double-walled carbon nanotubes can range from about 1 nanometer to about 50 nanometers. Diameters of the multi-walled carbon nanotubes can range from about 1.5 nanometers to about 50 nanometers.

The cold cathode can also include conductive materials, binding agent, getter particles, and so on. The conductive materials include at least one of metal particles, indium oxide ($In_2O_3$) particles, tin oxide ($SnO_3$) particles and indium tin oxide (ITO) particles. The metal particles include nickel particles or cadmium particles. The conductive materials can be used to strengthen the electrical connection between the one-dimensional field emitters, or between the one-dimensional field emitters and a base electrode. The cathode electrode can be electrically connected to the base electrode. In one embodiment, the conductive materials are ITO particles.

The binding agent can be made of trapezoidal poly-phenyl silsesquioxane (PPSQ), glass, or other inorganic materials. In one embodiment, the binding agent is glass powders or spin-on glass (SOG). The SOG is a liquid insulative material. In another embodiment, the binding agent is glass powder.

Figure 2:
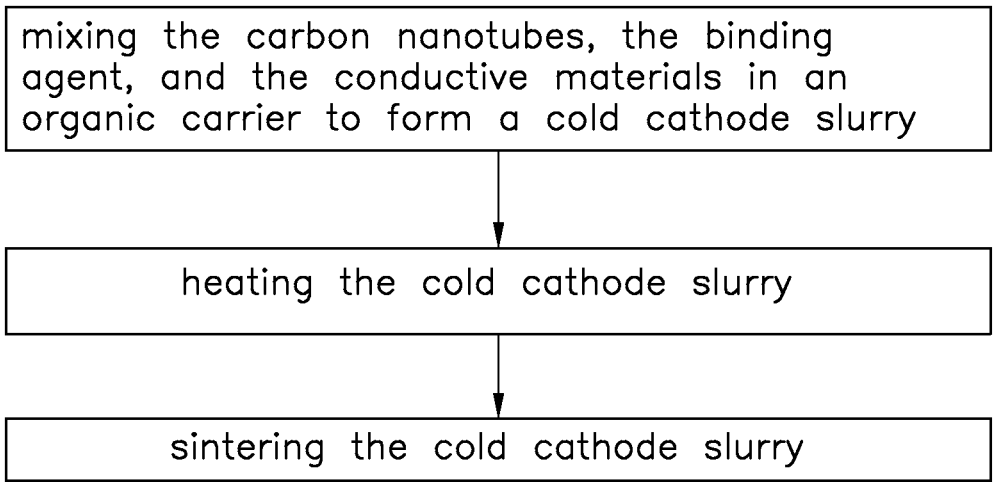
FIG. 2 is a chart of one embodiment of a method for making a cold cathode in FIG. 1.

Referring to FIG. 2, one embodiment of the cold cathode can be prepared by mixing the carbon nanotubes, the binding agent, and the conductive materials in an organic carrier to form a cold cathode slurry, heating the cold cathode slurry, and sintering the cold cathode slurry.

In one embodiment, the cold cathode can include the carbon nanotubes, the glass powders, and the ITO particles. The cold cathode slurry can contain carbon nanotubes in a range from about 5 wt % to about 15 wt %, the glass powders of about 5 wt %, the ITO particles in a range from about 10 wt % to about 20 wt %, and the organic carrier in a range from about 60 wt % to about 80 wt %. A length of the carbon nanotubes can be in a range from about 5 micrometers to about 25 micrometers. The length of the carbon nanotubes cannot be too long or too short. If the length of the carbon nanotubes is too long, the carbon nanotubes can be entangled or broken easily. If the length of the carbon nanotubes is too short, the field emission property of the carbon nanotubes would be weak.

The organic carrier can include terpineol, ethanol, ethylene glycol, isopropyl alcohol, hydrocarbons, water or a mixture thereof as a solvent, dibutyl phthalate as a plasticizer, and ethyl-cellulose as a stabilizer. A variety of organic solvents and organic additives configured to adjust viscosity, fluid or other physical properties of the cold cathode slurry, can be added thereto to meet requirements of the screen printing process. The organic additives include tackifiers, dispersants, or surface active agents. The use of organic solvents and organic additives have no special restrictions. The added amount of the organic solvents and organic additives is determined on the screen printing process. In one embodiment, the organic carrier includes ethanol and terpineol as the solvent, and ethyl cellulose as a stabilizer.

The organic carrier is vaporized during the process of heating the cold cathode slurry. After removal of the organic carrier, the glass powders, the carbon nanotubes, and the ITO particles are combined together by van der Waals attractive force. In one embodiment, the cold cathode slurry is heated to a temperature of about 150° C., and the ethanol and terpineol are vaporized.

During the process of sintering the cold cathode slurry, the binding agent is sintered to be melted or at least semi-melted. The binding agent fixes the conductive material and the one-dimensional field emitters therein, after being cooled to room temperature. In one embodiment, the binding agent is sintered to be semi-melted. If the binding agent is glass powder, a sintered temperature can be greater than the transition temperature of the glass powder. When the glass powder is heated to the transition temperature thereof, the glass powder is melted. In one embodiment, the sintering temperature is between a softening temperature and the transition temperature of the glass powder. When the glass powder is heated to the transition temperature between the softening temperature and the transition temperature, the glass powder is semi-melted. In one embodiment, the cold cathode slurry is heated to about 400° C. until the glass powder is semi-melted, and after cooling, the binding agent fixes the carbon nanotubes and ITO particles therein. Since the glass powders are heated to in a semi-melted state, after being cooled to room temperature, spaces exist between components (e.g., carbon nanotubes or ITO particles) of the acquired cold cathode. In one embodiment, the ethyl cellulose is vaporized during the sintering process.

The cold cathode can also consist of carbon nanotubes. The cold cathode comprising or consisting of carbon nanotubes can be prepared by chemical vapor deposition (CVD) method or by mixing the carbon nanotubes with a dimethylformamide solution, and removing the dimethylformamide. The carbon nanotubes can be mixed with the dimethylformamide solution with the aid of ultrasonic oscillation. The acquired cold cathode can have a plurality of carbon nanotubes with interspaces located therebetween.

The liquid glue is capable of solidifying. The liquid glue can be thermosetting glue, thermoplastic glue or UV-curable glue. Specifically, the liquid glue can be liquid silicone, or liquid crystal polysiloxane esters (PMMS), and so on. The liquid glue can be solidified by physical methods, such as heating, cooling, exposing to light, electron beam irradiating, or chemical methods, such as adding curing agent thereto. In one embodiment, the liquid glue is silicone glue.

The step of placing the liquid glue on the surface of the cold cathode can be executed by pouring the liquid glue on the surface of the cold cathode, and causing the liquid glue to flow and form a liquid film having a substantially uniform thickness. The step of causing the liquid glue to flow and form a liquid film having a substantially uniform thickness is executed by natural flow, orienting the cold cathode to cause the liquid glue to flow under gravity, or brushing the liquid glue, such as using a brush.

In one embodiment, the step of placing the liquid glue on the surface of the cold cathode can be executed by pouring the liquid glue on the surface of the cold cathode by a glue dispenser, the liquid glue naturally flowing to form the liquid film having a substantially uniform thickness.

The liquid glue can be in close contact with the cold cathode because the liquid glue has good liquidity. As a result, there will be no gap between the liquid glue and the cold cathode. In one embodiment, after the liquid glue is placed on the surface of the cold cathode, the liquid glue will penetrate into the space between the components of the cold cathode because there is space between the components of the cold cathode.

The step of curing the liquid glue can be chosen according to properties of the liquid glue. If the liquid glue is a thermosetting glue, the liquid glue can be cured gradual heating. Heating can be accomplished using a heating device, such as an oven, furnace, or other device. If the liquid glue is a thermoplastic glue, the liquid glue can be cured by gradual cooling. Cooling can be accomplished using a cooling device such as a recycled water cooler, hydraulic oil cooler, oil and water cooler, or other cooling device. If the liquid glue is UV-curable glue, the liquid glue can be cured by UV irradiation. It can be understood that other methods to solidify the liquid glue can be adopted. In one embodiment, the silicone glue is cured by heating to a temperature of about 150° C. for about 10 minutes. Since a portion of the liquid glue is penetrated in the space of the cold cathode, the bond force between the liquid glue and the cold cathode is intensified.

The step of removing the solid glue can be executed by taking the solid glue off directly or by using a tool, such as a clamp. After the solid glue is removed, the carbon nanotubes on the surface of the cold cathode are erect or upright (e.g., substantially perpendicular to the surface of the cold cathode). In one embodiment, in the process of sintering the cold cathode slurry, when the binding agent is sintered to be semi-melted, the binding agent contacting directly with the solid glue would adhere to the surface of the solid glue and depart from the cold cathode, thereby allowing more carbon nanotubes on the surface of the cold cathode to stand upright because spaces exist between components of the acquired cold cathode. In addition, the liquid glue penetrated in the spaces of the cold cathode has a greater binding force with the components of the cold cathode, compared to the binding force between components of the cold cathode. Further, there will be less residual solid glue left on the surface of the cold cathode.

The upright carbon nanotubes can further include a surface modification layer. A material of the surface modification layer can include zirconium carbide or titanium carbide. A work function of the surface modification layer can be lower than that of the carbon nanotubes, in which case the carbon nanotubes with surface modification can effectively reduce the work function of the field emitters of the cold cathode.

The method for surface treating the cold cathode has merit. Firstly, there is no need to control the heating temperature precisely during surface treating the cold cathode, simplifying the method. Secondly, because the liquid glue has good fluidity, the liquid glue can be in close contact with the surface of the cold cathode, no residual air bubbles exist therebetween, and a high probability of allowing the one-dimensional field emitters to stand upright. Lastly, since the liquid glue has good fluidity, any type of surface of the cold cathode can be treated, especially the surfaces that sticky tape cannot easily handle, such as surfaces having grooves thereon.

It is to be understood that the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

It is also to be understood that the above description and the claims drawn to a method may include some indication in reference to certain steps. However, the indication used is only to be viewed for identification purposes and not as a suggestion as to an order for the steps.

What is claimed is:

1. A method for surface treating a cold cathode, the method comprising:

providing a cold cathode, the cold cathode comprising a plurality of field emitters;

placing a liquid silicone glue on a surface of the cold cathode;

curing the liquid silicone glue to form a solid silicone glue on the surface of the cold cathode; and removing the solid silicone glue to allow the plurality of field emitters to stand upright.

2. The method of claim 1, wherein the plurality of field emitters is selected from the group consisting of nanotubes, nanowires, nanofibers, nanorods, and nanoribbons.

3. The method of claim 2, wherein the nanowires comprise oxide nanowires, nitride nanowires, or carbide nanowires.

4. The method of claim 2, wherein the plurality of field emitters is carbon nanotubes.

5. The method of claim 1, wherein the liquid silicone glue is cured by heating to a temperature of about 150° C. for about 10 minutes.

6. The method of claim 1, wherein the step of placing a liquid silicone glue on the surface of the cold cathode is executed by pouring the liquid silicone glue on the surface of the cold cathode, and causing the liquid silicone glue to flow and form a liquid film having a substantially uniform thickness.

7. The method of claim 6, wherein the step of causing the liquid silicone glue to flow and form the liquid film is executed by orienting the cold cathode to allow the liquid silicone glue to flow under gravity.

8. The method of claim 1, wherein the step of removing the solid silicone glue is executed by using a clamp.

9. The method of claim 1, wherein the cold cathode further comprises conductive materials and a binding agent.

10. The method of claim 9, wherein the binding agent is made of poly-phenyl silsesquioxane or glass.

11. The method of claim 9, wherein the conductive materials are selected from the group consisting of metal particles, indium oxide particles, tin oxide particles, and indium tin oxide particles.

12. The method of claim 9, wherein the cold cathode can be prepared by:

mixing the plurality of field emitters, the conductive materials, and the binding agent in an organic carrier to form a cold cathode slurry;

heating the cold cathode slurry; and sintering the cold cathode slurry.

13. The method of claim 12, wherein during the step of sintering the cold cathode slurry, the binding agent is sintered to be in a semi-melted state.

14. A method for surface treating a cold cathode, the method comprising:

providing a cold cathode, the cold cathode comprising a plurality of field emitters, the plurality of field emitters are carbon nanotubes;

placing a liquid silicone glue on a surface of the cold cathode;

curing the liquid silicone glue to form a solid silicone glue on the surface of the cold cathode, wherein the liquid silicone glue is cured by heating to a temperature of about 150° C. for about 10 minutes; and removing the solid silicone glue to allow the plurality of field emitters to stand upright.

* * * * *